US005639024A

United States Patent [19]

Mueller et al.

[11] Patent Number: 5,639,024

[45] Date of Patent: Jun. 17, 1997

[54] METHOD AND DEVICE FOR THE SIMULTANEOUS DISPERSION AND ATOMISATION OF AT LEAST TWO LIQUIDS

[75] Inventors: Claus Mueller, Kürten; Uwe Listner, Hürth; Martin Schweitzer, Leverkusen, all of Germany

[73] Assignee: Bayer Aktiengesellschaft, Leverkusen, Germany

[21] Appl. No.: 517,012

[22] Filed: Aug. 18, 1995

[30] Foreign Application Priority Data

Aug. 26, 1994 [DE] Germany ..... 44 30 307.6

[51] Int. Cl.[6] ..... A62C 5/00

[52] U.S. Cl. ..... 239/8; 239/419.3; 239/422; 239/423; 239/427.5; 239/432

[58] Field of Search ..... 239/8, 290, 416.5, 239/419, 419.3, 423, 427, 427.5, 428, 432

[56] References Cited

U.S. PATENT DOCUMENTS

| | | |
|---|---|---|
| 1,785,803 | 12/1930 | Adams . |
| 2,259,011 | 10/1941 | Taylor et al. . |
| 2,319,591 | 5/1943 | Ferguson . |
| 2,893,646 | 7/1959 | Batts . |
| 4,699,587 | 10/1987 | Shimoda et al. . |
| 5,484,107 | 1/1996 | Holmes ..... 239/428 X |

FOREIGN PATENT DOCUMENTS

| | | |
|---|---|---|
| 853725 | 4/1977 | Belgium . |
| 1099400 | 9/1955 | France . |
| 1320016 | 6/1973 | France . |
| 630863 | 5/1936 | Germany . |
| 1263619 | 3/1968 | Germany . |
| 2547707 | 4/1976 | Germany . |
| 26 45 142 A1 | 12/1977 | Germany . |
| 32 16 420 A1 | 11/1983 | Germany . |
| 3216420 | 11/1983 | Germany . |
| 3625659 | 2/1988 | Germany . |
| 4230535 | 3/1994 | Germany . |
| 677769 | 8/1979 | U.S.S.R. . |
| 1641449 | 4/1991 | U.S.S.R. . |
| WO83/02147 | 6/1983 | WIPO . |

OTHER PUBLICATIONS

Patent Abstracts of Japan, vol. 7, No. 7, abstract of JP 57-165066, (1983).

*Primary Examiner*—Andres Kashnikow
*Assistant Examiner*—Steven J. Ganey
*Attorney, Agent, or Firm*—Sprung Horn Kramer & Woods

[57] ABSTRACT

The invention relates to a method and a device for the simultaneous atomisation and dispersion of at least two liquids using propellant gas, whereby the resulting gas-liquid mixture is led through an atomising chamber comprising expansion zones arranged in series and flows out in the form of a spray cone from a nozzle orifice mounted downstream of the atomising chamber.

13 Claims, 3 Drawing Sheets

METHOD AND DEVICE FOR THE SIMULTANEOUS DISPERSION AND ATOMISATION OF AT LEAST TWO LIQUIDS

The invention relates to a method and a device for the simultaneous atomisation and dispersion of at least two liquids using propellant gas, whereby the resulting gas-liquid mixture is led through an atomising chamber comprising expansion zones arranged in series and flows out in the form of a spray cone from a nozzle orifice mounted downstream of the atomising chamber.

A method whereby a liquid is mixed with a propellant gas in an internal atomising chamber and then passes out through a nozzle orifice at the end of the atomising chamber is described in DE 32 16 420. The characteristic feature here is an internal mixing of liquid and propellant gas in zones arranged in series in accordance with fluid technology, wherein the propellant gas is expanded repeatedly and again compressed in its passage until it leaves the nozzle. In this manner a very efficient premixing takes place in the atomising chamber, before the mixture passes out of the nozzle having the conical annular orifice, and during this expansion is still further dispersed. By virtue of this sudden change of pressure the liquid is very finely atomised and is introduced into the surrounding space as a hollow cone.

Furthermore in DE 26 45 142 a method is described for producing a stream of at least two mixed and atomised fluids, whereby first of all the liquids and a propellant gas are brought together in a passage resembling an injector, mixed and initially atomised. The resulting gas-liquid mixture is then accelerated and, after leaving the body of the nozzle, impinges on a deflector or reflection device. A further mixing and atomisation takes place in this zone of reflection and impingement, which is regarded as the second mixing stage, before the atomised fluid mixture leaves the nozzle in the shape of an open parachute.

Using the mixing nozzles known hitherto, it is impossible simultaneously and with efficient mixing to atomise two or more liquids in the form of a closed hollow cone. An especial problem is in particular the dispersion and atomisation of several liquids if these liquids are insoluble in one another, or cannot be emulsified, or react chemically with one another. "Mutually incompatible" liquids of this kind are referred to below as "immiscible liquids". Another important application of the present invention is that two liquids having different properties are to simultaneously undergo combustion. The two liquids may, for example, have very different calorific values. In order to ensure an even combustion over time, the two liquids must be very well mixed with one another.

The invention is based on the object of developing a method and a device for the simultaneous dispersion and atomisation of several liquids using propellant gas, whereby the liquids are homogeneously and safely mixed, with efficient mixing, and are then atomised as a cluster of droplets in the form of a closed hollow cone. Immiscible liquids in particular are to be used.

This object is fulfilled according to the invention using an atomising chamber comprising expansion zones arranged in series and having a nozzle orifice mounted downstream, whereby a) prior to the entry into the atomising chamber, there are produced single streams $T_{l \ldots n}$ of the different liquids dispersed by the propellant gas, b) these single streams are fed into the atomising chamber rotationally symmetrically by distributor components and are thus directed onto an annular receiving duct in the atomising chamber; the single streams $T_{l \ldots n}$ impinge on the receiving duct in a cyclical sequence, viewed in the circumferential direction, c) and the resulting multiphase mixture of the liquids $F_{l \ldots n}$ and the propellant gas are alternately compressed and expanded in the atomising chamber in the direction of flow and then atomised through the nozzle orifice in the form of a hollow cone.

In the simplest case, when only two liquids $F_1$ and $F_2$ are to be mixed and atomised, the liquids $F_1$ and $F_2$ mixed with propellant gas are fed alternately into the atomising chamber in the circumferential direction as single streams $T_1$ and $T_2$; that is, the single streams $T_1$ and $T_2$ alternately impinge on the receiving duct, viewed in the circumferential direction.

The spray cone issuing at the nozzle orifice can advantageously be stabilised by the production within the nozzle orifice of a rotationally symmetrical curtain of gas having a radial flow component. For additional stabilisation, a gas having an axial flow component can also be blown in rotationally symmetrically outside the spray cone.

A preferred application of this multiphase mixing and dispersing method involves the multiphase mixture, consisting of several liquids and propellant gas, being sprayed in the form of a hollow cone through the nozzle orifice into the combustion chamber of a combustion plant and there undergoing combustion together with solid powdered fuels or liquid or gaseous fuels. Here one of the liquids can consist of a liquid waste product of variable calorific value, to which is added in the atomising chamber, as the second liquid, a liquid of high calorific value for the control of the flame temperature in the combustion chamber. A combustion of this kind can be employed with success in the thermal disposal of waste products containing chlorinated hydrocarbons. In this case the first of the liquids fed into the multiphase mixing nozzle therefore consists of the waste product containing chlorinated hydrocarbons and the other liquid consists of a liquid fuel.

The method according to the invention is carried out using a particular multiphase mixing nozzle, which consists essentially of a nozzle flange having feeds for the liquids and for propellant gas and a nozzle head having a circular nozzle orifice for atomising the gas/liquid mixture, as well as an atomising chamber containing several expansion zones arranged in series which is positioned between nozzle flange and nozzle head. This multiphase mixing nozzle is characterised in that, a) the nozzle flange possesses rotationally symmetrically arranged distributor components, which each consist of a liquid feed and propellant gas feed connected with one another and discharge into the atomising chamber, b) the propellant gas feed is connected with a gas collection channel and the liquid feeds are connected in groups with liquid collection channels, which are each provided with a connection for the feed of a liquid, c) and, viewed in the direction of flow, after the junction of the distributor components there is attached to the internal wall of the atomising chamber an annular receiving duct for the mixing and distribution of the single liquid streams $T_{l \ldots n}$ dispersed by the propellant gas.

The distributor components consist preferably of y-shaped pairs of drilled holes forming lateral ducts and common foot ducts, with the lateral ducts being connected with the collection channels for the gas and liquids and the foot ducts leading into the atomising chamber.

The receiving duct is advantageously provided on its inner side with a sharp cutting edge.

A further improvement consists in providing an annular orifice or radial gas ducts in the nozzle head in order to produce a gas curtain within the spray cone issuing from the nozzle orifice. An additional stabilisation of the spray cone can be achieved through a cylindrical gas curtain enveloping the spray cone. To this end paraxial gas ducts are provided in the nozzle flange. These measures in accordance with fluid technology prevent the atomised liquid particles from reaching the nozzle surface and the formation there of products which impede the nozzle action.

The shape of the spray cone can advantageously be varied, because the nozzle orifice is adjustable as regards its slit width.

The following advantages are gained by means of the invention.

The mixing and atomisation of two or more liquids can be effected within a very short period (0.005 s to 0.5 s).

Above all immiscible, in particular reactive liquids, which cannot be homogenised with one another in a vessel, can be mixed easily.

Liquids differing as regards their viscosity can likewise be evenly mixed and atomised.

It has become apparent that a self-purifying effect takes place owing to rapidly changing unstable flows in the atomising chamber and within the nozzle.

The close contact of the mixed liquids with the internal wall of the atomising chamber ensures an efficient heat transmission, so that the heat is rapidly transported through the liquid. For this reason a material having high temperature stability does not require to be used for the manufacture of the multiphase mixing nozzle.

The multiphase nozzle according to the invention is suitable both for small flow rates (5 l/h) and for large flow rates (10,000 l/h and more).

The multiphase mixing nozzle according to the invention operates with very high efficiency; that is, the quantity of propellant gas required in relation to the volumes of the liquids is comparatively small.

By using the multiphase mixing nozzle as a burner jet, a fuel mixture having a stable calorific value can be provided without difficulty when one or more liquid fuels have variable calorific values. This adjustment and regulation is of great importance primarily in the combustion of liquid waste fuels of varying composition, because a stable combustion with low emission of pollutants can thereby be achieved.

Air rich in oxygen can be supplied via the radial and axial air curtain all around the spray cone, so that a high stability of the flame is ensured even when low-grade fuel is used.

An extensive distribution of the fuel takes place in the combustion chamber owing to the high spray area of the hollow cone and the relatively small droplet density. An essential precondition for a good burn-out is thereby achieved.

The invention is explained in detail below with the aid of an Example illustrated in the drawings.

Figure 1:
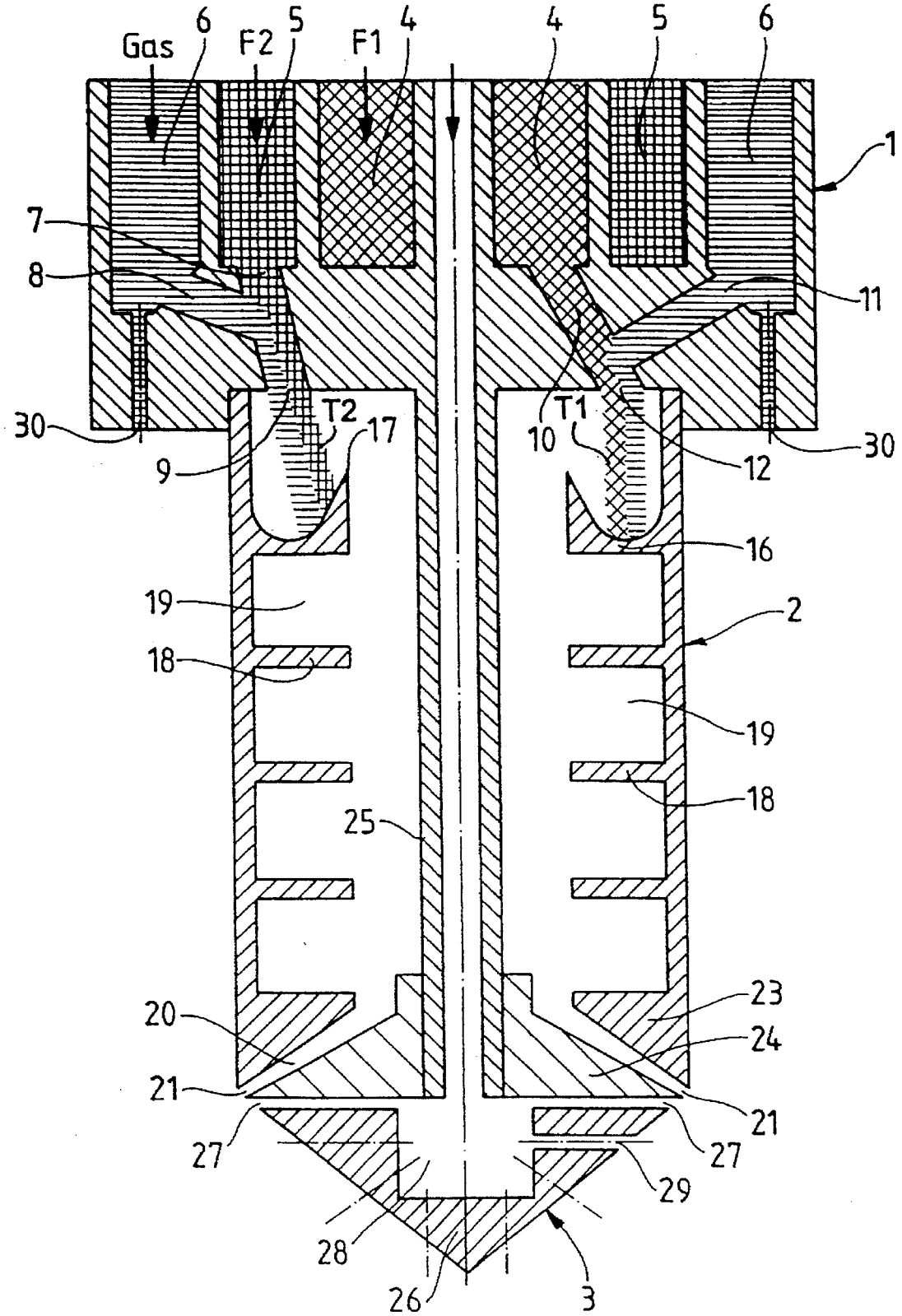
FIG. 1 shows a longitudinal section through the multiphase mixing nozzle

The multiphase mixing nozzle in FIG. 1 serves for the dispersion and atomisation of two liquids $F_l$ and $F_2$ using a propellant gas. The essential components of the multiphase mixing nozzle are the nozzle flange 1, the atomising chamber 2 and the nozzle head 3. The two liquids $F_1$ and $F_2$ reach the atomising chamber 2 through distributor components, which are arranged in a circle in the nozzle flange 1. The distributor components consist for their part of y-shaped drilled branching holes forming 2 lateral ducts and in each case a common foot duct. Collection channels 4 and 5 for the two liquids $F_1$ and $F_2$ and a gas collection channel 6 for the delivery of the propellant gas are arranged in the nozzle flange 1. One lateral duct 7 of a distributor component for the liquid $F_2$ is connected with the collection channel 5 and the other lateral duct 8 is connected with the gas collection channel 6. The two lateral ducts 7 and 8 run towards one another at an acute angle and pass into the common foot duct 9, which leads into the atomising chamber 2. The distributor components for the liquid $F_1$ are similarly constructed. A lateral duct 10 leads respectively into the liquid collection channel 4, the other lateral duct 11 is again connected to the gas collection channel 6. The two lateral ducts 10 and 11 in turn are brought together to a foot duct 12, which leads into the interior of the atomising chamber 2. The propellant gas thus impinges on the liquid $F_1$ via the lateral duct 11 and on the liquid $F_2$ via the lateral duct 8. The lateral ducts are dimensioned so that the loss of pressure is maintained as low as possible and the energy of atomisation available can be utilised effectively by the subsequently adjoining atomising chamber 2. The distributor components for the two liquids $F_1$ and $F_2$ are arranged alternating with one another on a circle in the nozzle flange 1 (see FIG. 2). Where there are more than two liquids a cyclical sequence, for example, $F_1$, $F_2$, $F_3$, $F_4$, $F_1$, $F_2$, $F_3$, $F_4$ is provided.

Figure 3:
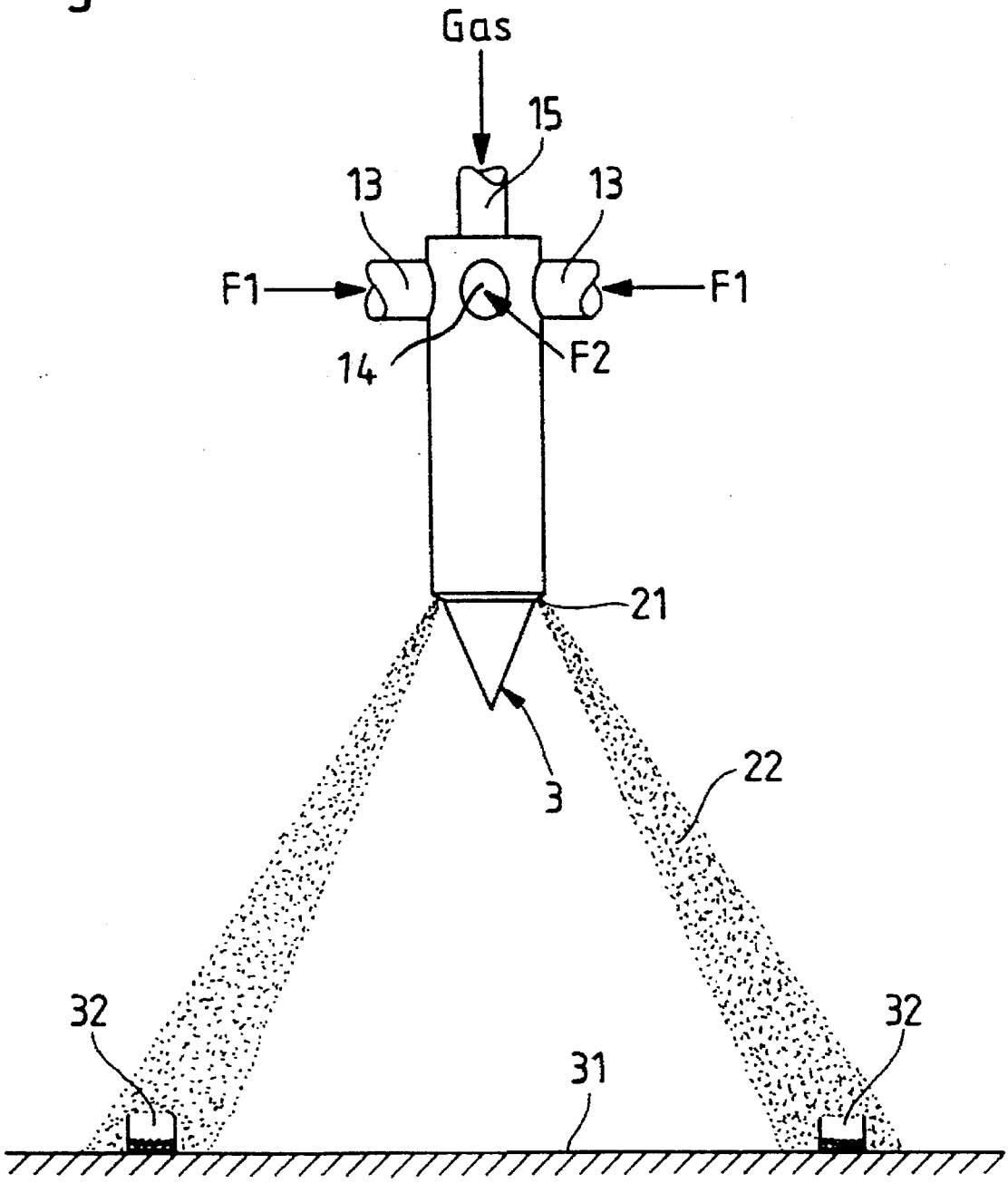

It is indicated in FIG. 3 that the liquid collection channel for the liquid $F_1$ is provided with liquid feeds 13 and the liquid collection channel for the liquid $F_2$ is provided with a liquid feed 14. The propellant gas (compressed air) is supplied to the gas collection channel 6 through the gas feed 15 (see FIG. 3).

The foot ducts 9 and 12 forming part of the distributor components are arranged in the nozzle flange 1 in such a manner that the liquids flowing through and accelerated by the propellant gas first of all impinge on an annular receiving duct 16 positioned in the upper part of the atomising chamber 2. The receiving duct 16 has on its inner side (to the nozzle axis) a sharp cuffing edge 17. The single streams $T_{l \ldots n}$ dispersed by the propellant gas are distributed in the groove-shaped depression of the receiving duct 16. The two liquid streams $F_1$ and $F_2$ respectively divided in the liquid collection channels are intimately mixed for the first time by the impingement and homogenising in the receiving duct 16. An initial atomisation of the previously mixed liquids $F_1$ and $F_2$ takes place against the cutting edge 17 of the receiving duct 16. A further atomisation and mixing then takes place in the expansion zones 19 formed by webs 18 in the atomising chamber 2. The expansion zones 19 are arranged, in accordance with fluid technology, in series in the atomising chamber 2 so that the multiphase gas/liquid mixture is alternately compressed and decorepressed in the atomising chamber 2. Highly efficient mixing is achieved through this alternating compression and expansion.

At the outlet of the atomising chamber 2 the multiphase mixture consisting of the propellant gas and the liquids $F_1$ and $F_2$ is accelerated through an annular outlet orifice 20 which tapers conically in the direction of the flow. The annular outlet orifice 20 at the nozzle head 3 is arranged at an obtuse angle to the nozzle axis. Since the pressure viewed in the direction of flow decreases owing to the pressure losses during the compression and expansion in the expansion zones 19 arranged in series, with a constant mass flow the volume of the stream increases. At the opening 21 of the outlet orifice 20 there takes place for the last time an atomisation of the compressed multiphase mixture with the formation of a hollow cone 22 (see FIG. 3). The cluster of droplets composed of the multiphase mixture thus leaves the nozzle head 3 through the opening 21 along a surface of the cone.

The outlet orifice 20 is delimited on one side by a conical crosspiece 23 at the end of the atomising chamber 2 and on the other side by a conical wedge 24 forming part of the nozzle head. The conical wedge 24 is arranged so as to be vertically adjustable along a central internal pipe 25 which runs from the nozzle flange 1. In this way the slit width of the outlet orifice 20 can be adjusted. The flow rate and also the shape of the hollow cone can be influenced within certain limits by adjusting the slit width.

A conical cap 26 is screwed onto the vertically adjustable conical wedge 24 in such a way that between the conical wedge 24 and the conical cap 26 there remains an annular orifice 27 the opening whereof immediately adjoins the outlet orifice 21. The conical wedge 24 and the conical cap 26 together form the nozzle head 3. The annular orifice 27 is connected with a central distribution space 28 in the conical cap 26, which is in turn connected with the internal pipe 25. The distribution space 28 is additionally supplied with gas ducts 29 directed radially outwards. An inert gas (air or nitrogen), which flows across the distribution space 28 through the annular orifice 27 and the gas ducts 29, can be supplied to the central internal pipe 25 via the nozzle flange 1. In this way a rotationally symmetrical gas curtain having a radial flow component is produced inside the spray cone. This gas curtain has the task of replenishing the partial vacuum forming in the region of the conical cap 26. Without this replenishment there is a tendency for the cluster of droplets in the shape of a hollow cone to collapse underneath the outlet orifice 21. The atomisation would then assume the form of a full cone, with a bulging extension appearing in the vicinity of the outlet.

It was moreover observed that above the spray cone in the vicinity of the wall of the atomising chamber 2 a partial vacuum is also formed, which may likewise give rise to instabilities. In order to avoid this a gas, for example air, having an axial flow component is also blown rotationally symmetrically outside the spray cone by means of the axial gas ducts 30 in the extension of the gas collection channel 6 in the nozzle flange 1. The spray cone is stabilised still further by this cylindrical gas curtain. Instead of the rotationally symmetrically arranged axial gas ducts 30, other distributor components, for example, an annular orifice interrupted at regular distances, may of course be provided.

Figure 2:
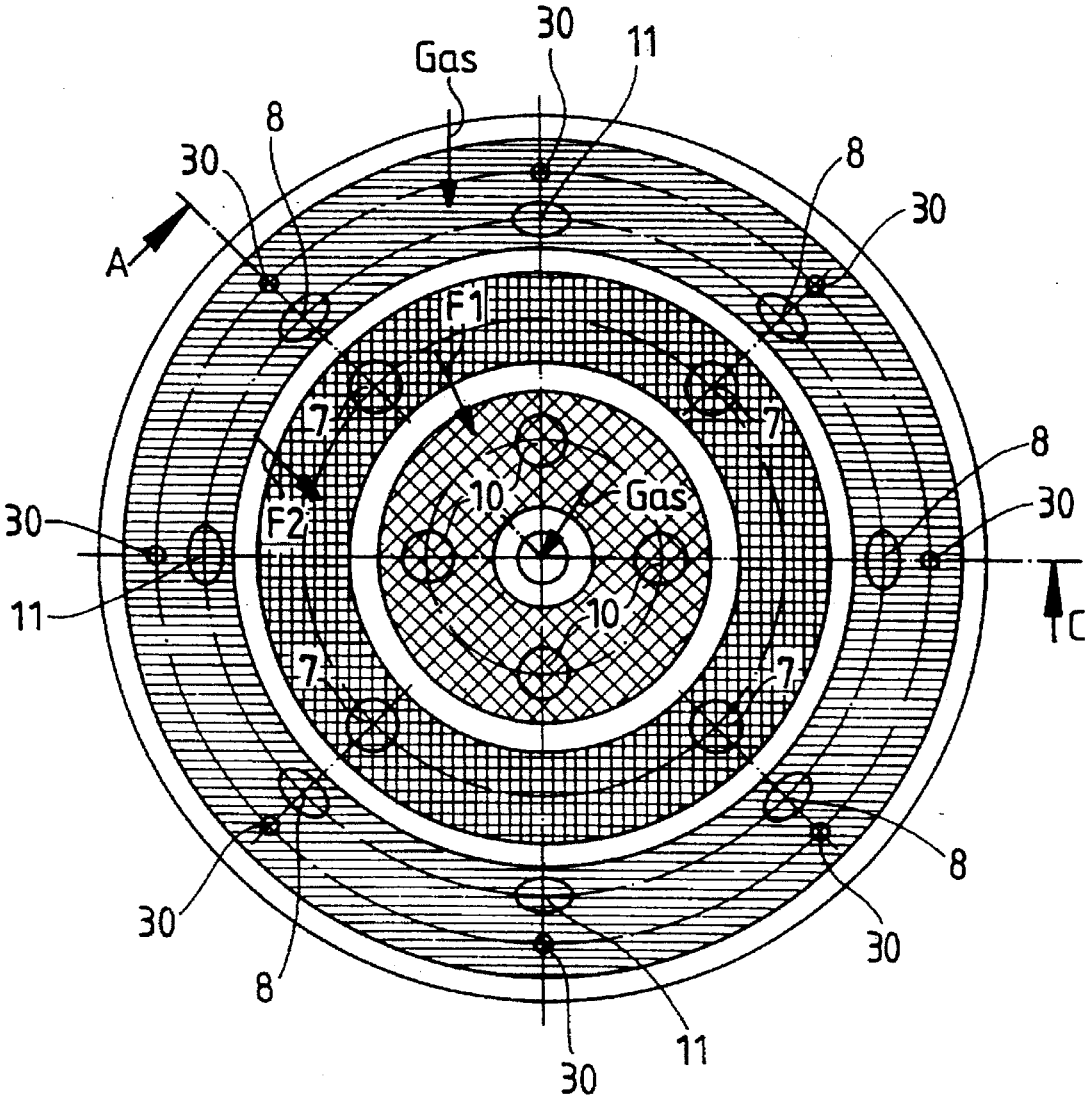
FIG. 2 shows a section AA' through the nozzle flange of the multiphase mixing nozzle and FIG. 3 shows the spray pattern of the multiphase mixing nozzle.

The annular liquid collection channels 4 and 5 for the liquids $F_1$ and $F_2$ and the externally arranged, likewise annular gas collection channel 6 are particularly apparent in FIG. 2, which shows a transverse section through the nozzle flange 1. From the collection channels, distributed at a regular distance around the circumference, the lateral ducts 10 and 7 for the liquids $F_1$ and $F_2$ and the lateral ducts 11 and 8 for the propellant gas pass obliquely downwards, with the lateral ducts 11 for the gas uniting with the lateral ducts 10 for the liquid (for the liquid $F_1$) and the lateral ducts 8 for the gas uniting with the lateral ducts 7 for the liquid (for the liquid $F_2$) (y-shaped distributor ducts). The axial gas ducts 30 are arranged close to the lateral ducts 8 and 11 for the gas which originate from the base of the gas collection channel 6.

FIG. 3 is a schematic representation of the cluster of droplets 22 issuing in the form of a hollow cone from the outlet orifice 21 at the nozzle head 3. It was possible to establish the homogeneous distribution of the liquids $F_1$ and $F_2$ by means of small test crucibles 32 placed on the tray 31 inside the spray cone 22 through subsequent analysis of the samples.

In an experiment, 1000 l/h of each of the liquids $F_1$ and $F_2$ and 130 $m^3$/h of compressed air (referred to standard conditions) were supplied to the multiphase mixing nozzle. The drop in pressure in the multiphase mixing nozzle was 2.6 bar and the angle of spray of the hollow cone was 95°. The volume of the atomising chamber 2 was 120,000 $mm^3$. With the system pressure of 2.6 bar associated with the multiphase mixing nozzle, a residence time of 13 ms, to be identified with the mixing time, resulted in the atomising chamber 2.

By means of the multiphase mixing nozzle described it is possible to mix intimately and atomise two or more liquids having greatly differing physical properties. Because of the extremely short average residence time in the entire multiphase mixing nozzle, ranging from 5 to 100 ms, chemical reactions proceeding slowly between the liquids do not result in any impairment of the quality of the atomisation either. It has also been found that, because of the extremely short residence time in the multiphase mixing nozzle, even polymerising liquids can be mixed with one another and the mixture can be atomised without difficulty. The multiphase mixing nozzle renders possible in practice an in situ mixing and atomisation. Polymerising liquids cannot, for example, be premixed in a tank and subsequently atomised. Furthermore, caking on the nozzle head in the form of salts or polymers is effectively and permanently prevented by the described flow control in the vicinity of the outlet orifice 21 (axial and radial gas curtain). It has moreover been found that the multiphase mixing nozzle requires only relatively low admission pressures for the propellant gas and the liquids in the range of from 1 to 4 bar. This also renders possible the atomisation of highly viscous mixtures of liquids.

A preferred application of the method according to the invention consists in placing the multiphase mixing nozzle in the combustion chamber of a combustion plant and producing therein a cluster of droplets in the form of a hollow cone. In particular the combustion of liquid waste products having a highly variable calorific value can thereby be carried out successfully. To this end the waste product is delivered to the multiphase mixing nozzle as liquid $F_1$ and a liquid fuel of high calorific value is delivered as the liquid $F_2$. The mass flow of the liquid fuel $F_2$ can be regulated so that the temperature in the combustion chamber remains constant. The temperature in the combustion chamber is the reference variable for the mass flow of the fuel. It is also possible to introduce into the multiphase mixing nozzle controlled quantities of a reactive liquid which elevates or lowers the flame temperature, in order to maintain the flame temperature constant. But the method according to the invention is suitable above all for the disposal of troublesome liquid waste products in the chemical industry. To this end, for example, various immiscible effluents or effluent concentrates together with a liquid fuel are fed to the multiphase mixing nozzle, atomised and burnt. Here the combustion process can be improved by the radial and rotationally symmetrical gas curtains (from the annular orifice 27 and the axial gas ducts 30), if the gas used is oxygen-rich air, so that the gas curtains act as an additional oxygen supply which supports and stabilises combustion. The method according to the invention can be used in particular for the thermal waste disposal (combustion) of waste products containing chlorinated hydrocarbons with low and above all constant concentrations of residual pollutants; here one of the liquids fed to the multiphase mixing nozzle consists of the waste liquid containing chlorinated hydrocarbons, to which in the atomising chamber a liquid fuel is added as the second liquid.

We claim:

1. Method for the simultaneous atomisation and dispersion of at least two liquids $F_{l \ldots n}$ using propellant gas, whereby the resulting gas-liquid mixture is led through an atomising chamber (2) comprising expansion zones (19) arranged in series and flows out in the form of a spray cone (22) from a nozzle orifice (20) mounted downstream of the atomising chamber (2), characterised in that, a) prior to the entry into the atomising chamber (2), there are produced single streams $T_{l \ldots n}$ of the different liquids dispersed by the propellant gas, b) these single streams are fed into the atomising chamber (2) rotationally symmetrically by distributor components and are thus directed onto an annular receiving duct (16) in the atomising chamber (2), the single streams impinge on the receiving duct (16) in a cyclical sequence, viewed in the circumferential direction and c) the resulting multiphase mixture of the liquids $F_{l \ldots n}$ and the propellant gas are alternately compressed and expanded in the atomising chamber (2) in the direction of flow and then atomised through the nozzle orifice (20) in the form of a hollow cone (22).

2. Method according to claim 1, characterised in that in two liquids $F_1$ and $F_2$ the single streams $T_1$ and $T_2$ appertaining thereto alternately impinge in the circumferential direction on the receiving duct (16).

3. Method according to claims 1, characterised in that a rotationally symmetrical gas curtain having a radial flow component is produced within the spray cone (22) in the vicinity of the nozzle orifice (20).

4. Method according to claim 3, characterised in that for additional stabilisation, a gas having an axial flow component is also blown in rotationally symmetrically outside the spray cone (22).

5. Method according to claim 1, characterised in that the multiphase mixture is sprayed in the form of a hollow cone through the nozzle orifice (20) into the combustion chamber of a combustion plant and there undergoes combustion together with solid powdered fuels or liquid or gaseous fuels.

6. Method according to claim 5, characterised in that one of the liquids $F_1$ consists of a liquid waste product of variable calorific value, to which in the atomising chamber (2) is added, as the second liquid $F_2$, a liquid of high calorific value for the control of the flame temperature in the combustion chamber.

7. Method according to claim 5, characterised in that one of the liquids $F_1$ consists of a waste product containing chlorinated hydrocarbons, to which in the atomising chamber (2) a liquid fuel is added as the second liquid $F_2$.

8. Multiphase mixing nozzle for the simultaneous atomisation and dispersion of at least two liquids $F_{l \ldots n}$ using propellant gas, comprising of a nozzle flange (1) having feeds (13, 14) for the liquids and (15) for propellant gas and a nozzle head (3) having a circular nozzle orifice (20) for atomising the gas/liquid mixture, as well as an atomising chamber (2) containing several expansion zones (19) arranged in series which is positioned between nozzle flange (1) and nozzle head (3), characterised in that a) the nozzle flange (1) possesses rotationally symmetrically arranged distributor components, which each consist of a liquid feed (10, 7) and propellant gas feed (11, 8) connected with one another and discharge into the atomising chamber (2), b) the propellant gas feed (15) is connected with a gas collection channel (6) and the liquid feeds (13, 14) are connected in groups with liquid collection channels (4, 5), c) and, viewed in the direction of flow, after the junction of the distributor components there is attached to the internal wall of the atomising chamber (2) an annular receiving duct (16)for the mixing and distribution of the single liquid streams $T_{l \ldots n}$ dispersed by the propellant gas.

9. Multiphase mixing nozzle according to claim 8, characterised in that the distributor components consist of y-shaped pairs of drilled holes forming lateral ducts (10, 11 and 7, 8) and common foot ducts (12, 9), with the lateral ducts (10, 11, 7, 8) being connected with the collection channels for the gas and liquids (4, 5, 6) and the foot ducts (9, 12) being directed onto the receiving duct (16).

10. Multiphase mixing nozzle according to claim 8, characterised in that the receiving duct (16) is provided on its inner side with a cutting edge (17).

11. Multiphase mixing nozzle according to claim 8, characterised in that an annular orifice (27) or radial gas ducts (29) are arranged in the nozzle head (3) in order to produce a gas curtain within the spray cone (22) issuing from the nozzle orifice (20).

12. Multiphase mixing nozzle according to claim 8, characterised in that the nozzle flange (1) possesses gas ducts (30) which are directed onto the external surface of the spray cone (22).

13. Multiphase mixing nozzle according to claim 8, characterised in that the nozzle orifice (20) is adjustable as regards the slit width.

* * * * *